US005141404A

United States Patent [19]

Newcomer et al.

[11] Patent Number: 5,141,404

[45] Date of Patent: Aug. 25, 1992

[54] PUMP APPARATUS

[75] Inventors: Kevin Newcomer, Monroe; Steven Richter, Ann Arbor; both of Mich.

[73] Assignee: Q.E.D. Environmental Systems, Inc., Ann Arbor, Mich.

[21] Appl. No.: 543,218

[22] Filed: Jun. 25, 1990

[51] Int. Cl.[5] ..... F04F 1/08

[52] U.S. Cl. ..... 417/130; 417/133; 417/138

[58] Field of Search ..... 417/126, 130, 133, 138, 417/144; 91/275, 307

[56] References Cited

U.S. PATENT DOCUMENTS

| | | | |
|---|---|---|---|
| 923,587 | 6/1909 | Schwaninger . | |
| 1,323,864 | 12/1919 | Human . | |
| 1,600,385 | 10/1926 | Aikman . | |
| 1,626,072 | 4/1927 | Brady . | |
| 2,007,745 | 7/1935 | Coy et al. . | |
| 2,017,353 | 10/1935 | Parks . | |
| 2,206,447 | 7/1940 | Berry | 417/133 |
| 2,667,995 | 2/1954 | Pool et al. . | |
| 2,733,667 | 2/1956 | Hill . | |
| 2,893,427 | 7/1959 | Felgate . | |
| 3,035,524 | 5/1962 | Kastner | 91/275 |
| 3,082,698 | 3/1969 | Smith . | |
| 3,606,585 | 9/1971 | Graves . | |
| 3,676,019 | 7/1972 | Self . | |
| 3,905,724 | 10/1975 | Strebel . | |
| 3,930,755 | 1/1976 | Lahr et al. . | |
| 4,025,237 | 5/1977 | French . | |
| 4,050,854 | 9/1977 | Hereford et al. . | |
| 4,083,661 | 4/1978 | McPherson et al. . | |
| 4,161,485 | 4/1981 | Borg . | |
| 4,360,038 | 11/1982 | Trinkwalder, Jr. . | |
| 4,395,200 | 7/1983 | Anthony et al. . | |
| 4,415,314 | 11/1983 | Chappell . | |
| 4,439,110 | 3/1984 | Massaux . | |
| 4,524,797 | 6/1985 | Lungu . | |
| 4,527,533 | 7/1985 | McLaughlin et al. . | |
| 4,562,855 | 1/1986 | Cummings et al. . | |
| 4,625,807 | 12/1986 | Harlow . | |
| 4,662,271 | 5/1987 | Wolterman . | |
| 4,750,705 | 6/1988 | Zippe . | |
| 4,761,225 | 8/1988 | Breslin . | |
| 4,792,113 | 12/1988 | Eidsmore . | |
| 4,794,890 | 1/1989 | Richeson, Jr. . | |
| 4,826,406 | 5/1989 | Wells . | |
| 4,865,073 | 9/1989 | Kocher . | |
| 4,889,035 | 12/1989 | Goodnow | 91/275 |

FOREIGN PATENT DOCUMENTS

| | | |
|---|---|---|
| 1001060 | 1/1957 | Austria . |
| 2199117A | 6/1988 | United Kingdom . |

*Primary Examiner*—Richard A. Bertsch
*Assistant Examiner*—Michael I. Kocharov
*Attorney, Agent, or Firm*—Harness, Dickey & Pierce

[57] ABSTRACT

A pump apparatus for pumping undergound fluids from a well. The pump includes inner and outer chambers, and a float slidable within the outer chamber. A source of compressed air is directed to a valve on the pump. The valve controls the flow of the compressed air into the outer chamber during the pumping cycle, and also controls the opening of a vent during the intake cycle. The float, while sliding up and down within the outer chamber in response to the fluid level within the chamber, activates the valve to begin the pumping of fluid when the chamber is full. When the chamber is empty, the float activates the valve is turn off the compressed air.

5 Claims, 3 Drawing Sheets

PUMP APPARATUS

BACKGROUND OF THE INVENTION

1. Technical Field

The present invention relates generally to underground fluid pumping systems and more particularly, to such pumps which are capable of activating in response to surrounding liquid levels.

2. Discussion

Increased monitoring of environmental quality has resulted in a substantial rise in the number of identified sites of contaminated ground water. Accompanying this trend has been an increased effort to clean up these sites. In response, there is a need for improved below ground pumping systems to assist in these clean up efforts.

Ideally, pumping systems used for these purposes will have a number of characteristics. Because of the large number of pumps required is it desired to minimize the cost of each pump and installation. Accordingly, such pumps should be relatively simple and inexpensive and should fit in a small diameter well due to the increased cost of drilling larger diameter wells. To minimize maintenance and repair costs, the pumps should have a minimum of moving parts and should have high reliability. Also, such pumps should be able to withstand corrosive fluid streams without failure.

Due to the possibility of exposure to explosive gases pneumatic pumps are preferred over electrical pumps for pumping waste products. However, many of the currently used pneumatic pumps have a number of drawbacks. For example, many pumps in current use require external controlling devices which use timers to activate the pump on a fixed schedule. However, the necessity of external controllers adds considerably to the cost and complexity of the overall pumping system. In addition, the use of a fixed time pumping schedule has disadvantages since it may not result in pumping at the most opportune time to obtain maximum production. For example, such a configuration would not sense variations in the flow rate of fluid into the pump and may result in too fast or too slow pump cycles.

There are pumps which avoid the necessity of external controllers by incorporating sensing means within the pump to detect when fluid has entered the pump to a desired level. Unfortunately, the prior pumps which are capable of self activation have not proved satisfactory in many applications. One problem has been with the mechanical actuating and sensing mechanism within the pumps. Generally, such pumps use a float which raises when the pump fills and lowers when the pump is empty. Actuating mechanisms which sense the movement of this float sometimes require considerable force to switch the pumps pneumatic valve on and off. This results in the necessity of a fairly large and heavy float which increases the overall size and cost of the pump system. In addition, the actuating mechanisms in prior pump systems are exposed to the pumped fluid which may be highly corrosive. Thus, pump systems which are suitable for use in pumping inert materials may fail prematurely when the actuating mechanism is exposed to a highly corrosive fluid such as maybe found in contaminated well sites such as landfills.

In addition to problems with the actuating mechanism, the pneumatic valve used to control the flow of compressed air into these pumps have often proved unreliable. Spool type valves incorporating sliding seals are generally used in prior pumps of this nature. The force necessary to move these sliding seals to actuate spool type valves are one source of excess actuation force requiring the above mentioned large and heavy floats. In addition, spool type valves result in high maintenance and repair costs due to their tendency to freeze or to leak. There are a number of causes of the difficulties with sliding seals. These include debris entering the seals from the source of compressed air; contamination of the seals from the liquid being pumped; (especially where highly corrosive waste products are pumped) loss of lubrication in the seals; and compression set of the elastomeric seals if they remain inactive for an extended period of time. In addition, some pumps employ valves which have a significant cross over point where air supply is partially open and exhaust is partially closed. At this point the pump will tend to use a large amount of compressed air in an effort to switch to fully open or fully closed. In some cases the pump may reach a steady state with the head pressure in the surrounding well and remain in a cross over, or all ports open, position.

Another difficulty with sliding seals results from their use to provide a detent action between the discharge and refill cycles of the valve. As the sliding seals (which generally comprise of o-rings) wear, the ability of the o-rings to provide a detent action will be lost. This will result in short and erratic pump cycles unless the o-rings are replaced. Thus, it would be desirable to provide an underground pumping which overcomes some or all of the above-mentioned difficulties.

Accordingly, it is an object of the present invention to provide a simple and inexpensive pumping system for installing in small diameter wells. It is a further object of the present invention to provide such a pumping system which is reliable, has few moving parts, and which provides automatic on/off level control to eliminate the need for external controllers.

It is an additional object of the present invention to provide a underground pumping system which uses a pneumatic valve that avoids the use of sliding seals and which is switched from between pumping to discharge cycles with a minimum of actuation force. It is a further object for the present invention to provide such a system having a reliable and durable detent between pump discharge and refill cycles. It is still a further object of the present invention to provide an underground pump system in which the pneumatic valve is substantially isolated from the corrosive waste fluid stream.

SUMMARY OF THE INVENTION

There is provided according to present invention, a device for inexpensively and reliably pumping underground fluids.

Toward this end, a system is provided for directing liquid out of a well having an outer tube forming an outer chamber therein and inner tube forming an inner chamber therein. An inlet means is located at a first end of said tubes for permitting liquids to enter the outer and inner chambers. A cap is disposed at a second of the tubes, the cap containing a discharge port in communication with the second end of the inner tube. An air inlet port is located in said cap for permitting pressurized air to enter the second end of the outer tube. A vent port is provided for permitting air in the outer chamber to escape to atmosphere when fluid is entering the chambers. A float is slidably disposed inside the outer tube which is buoyant in the liquid so that it may slide from the first end to the second end of the outer tube in response to the level of the liquid in the outer chamber. A valve is disposed in the inlet port for selectively admitting in a discharge mode, and blocking in a refill mode the source of compressed air into the outer chamber and for also selectively venting in the refill mode, and blocking in the discharge mode, the outer chamber to the vent port. An actuating rod means responsive to the position of the float and coupled to the valve is provide for actuating the valve from the first mode to the second mode so that liquid is admitted into the inner and outer chambers during the refill mode and forced from the outer chamber through the inner chamber at the discharge port during the discharge mode.

In accordance with one embodiment of the present invention the actuating means includes an actuating rod in said outer chamber movable by said float, first and second opposing magnets, the first magnet being near one end of the actuating rod and the second magnet being located within the cap means but isolated from the outer chamber and movable by the first magnet in response to the motion of the float. The second magnet communicates with the valve to cause the valve to switch from one mode to the other.

In accordance with another aspect of the present invention, the valve is a pneumatic bleed-type air piloted three way control valve actuated by the actuating means.

BRIEF DESCRIPTION OF THE DRAWINGS

Additional objects, advantages an features of the present invention will become apparent from the following description and appended claims, taken in conjunction with the accompanying drawings.

DETAILED DESCRIPTION OF THE PREFERRED EMBODIMENTS

Figure 1:
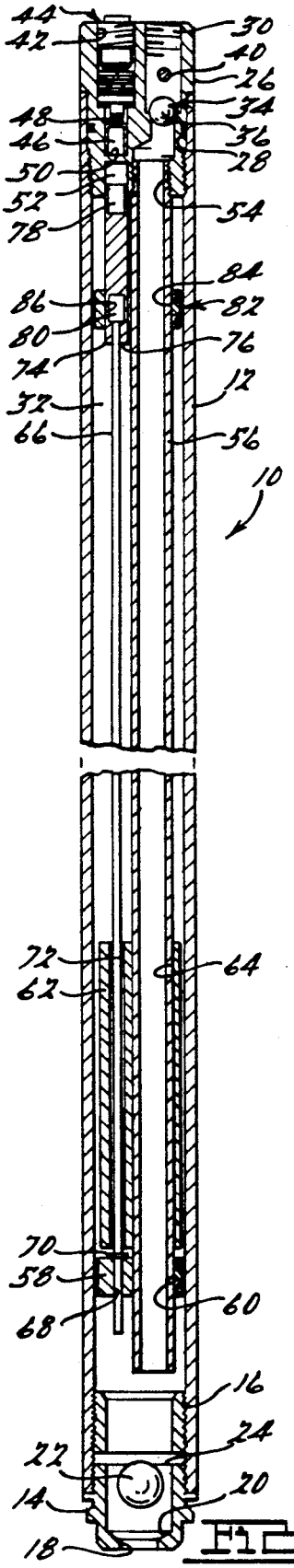
FIG. 1 is a longitudinal cross-sectional view of the pump apparatus in accordance with the present invention shown in the refill cycle.

Referring to FIG. 1, there is shown, a pump apparatus 10 in accordance with a preferred embodiment of the present invention. The pump includes a hollow outer tube 12 which forms the main body of the pump 10. The outer tube 12 is preferably composed of a rigid material not susceptible to corrosion, such as stainless steel. The outer tube 12 is closed at its lower end by a liquid inlet port 14 which is inserted into the lower end of the outer tube 12 in a reduced diameter portion 16 of the outer tube 12 to form a liquid tight seal between the liquid inlet port unit 14 an the outer tube 12. The liquid inlet port 14 includes an inlet port 18, a valve seat 20, and a check ball 22. A check ball stop 24 serves to confine the check ball to within the inlet port 14.

At the opposite end of the outer tube 12, is a pump cap 26 which, like the inlet port 14, is secured to the end of the outer tube 12 by inserting it into a reduced diameter portion 28 of the outer tube 12 to form a liquid and air tight seal with the outer tube 12. (The pump cap 26 may be preferably composed of a nonmagnetic material such as a plastic, for example, nylon, PVC or Teflon. The pump cap 26 includes a liquid discharge port 30 which passes through the pump cap 26 to the pump chamber 32 in the interior of the outer tube 12. The liquid discharge port 30 contains a discharge check valve 34 which includes a discharge check ball 36, a discharge check valve seat 38 and a check ball stop 40. The pump cap 26 includes an air inlet port 42 into which is inserted a pneumatic valve 44 which will be discussed in greater detail below. Below the pneumatic valve 44 in the air inlet port 42 is a pilot magnet 46 and an air pilot bias spring 48, which biases the pilot magnet 46 in a position away from the pneumatic valve 44 and against the bottom portion 50. An actuating magnet 78 is located in the pump cap 26.

At the inward portion of the liquid discharge port 30, is an opening 54 into which is inserted an inner discharge tube 56. The inner discharge tube 56 is preferably constructed of a rigid material not susceptible to corrosion, such as stainless steel, Nylon, or PVC. The inner discharge tube 56 extends into the pump chamber 32 to a point close to the liquid inlet port 14. A lower pump guide 58 is secured to the interior of the pump chamber 32 and includes an opening 60 into which the inner discharge tube 56 is inserted. A float 62 is disposed inside the pump chamber 32 having an axial bore 64 into which the inner discharge tube 56 is inserted. There is sufficient clearance between the axial bore 64 and the inner discharge tube 56 to permit the float 62 to freely slide up and down along the inner discharge tube 56. The float is preferably made of a material which is less dense than the liquid to be pumped to provide sufficient lifting action when the pump is filled as will be explained in more detail below. In addition, it is necessary for the float to have sufficient dry weight when the pump is empty to de-actuate the pneumatic valve 44 as described below. A suitable material for float 62 may be, for example, syntactic epoxy, stainless steel or other resins.

An actuation rod 66 is disposed adjacent to the inner discharge tube 56 in the pump chamber 32. The lower end of the actuation rod 66 is inserted into an axial bore 68 in the lower pump guide 58. A lower float-actuator rod stop 70 is affixed to the actuation rod 66 above the lower pump guide 58. The actuation rod 66 is also inserted into a second float axial bore 72. Both the lower pump guide axial bore 68 and the second float axial bore 72 are large enough to provide sufficient clearance around the actuation rod 66 to permit the actuation rod to freely move up and down with respect to the float 62 and the lower pump guide 58. The actuation rod 66 is preferably made of a light weight and rigid material such as nylon. At the upper end of the actuation rod 66 is an actuation head 74 which has a larger diameter than the actuation rod 66, the lower surface of which forms a first float stop 76. The actuation rod head 74 also includes at the extreme upper end an actuator magnet 78. The actuator magnet 78 is carried in the actuator head 74 with the north pole of the magnet at the extreme upper end, and the south pole immediately below. The actuator head 74 is inserted into the actuating magnet bore 52. The actuator head 74 also carries a snap action latch magnet 80 at its lower portion with the north pole of the magnet on the upper end of the south pole at its lower end. Adjacent to the snap action latch magnet 80 is a guide and a snap action magnet assembly 82 which is rigidly attached to the outer tube 12 and includes an axial bore 84 into which the inner discharge tube 56 is inserted and which also includes a second bore 86 into which the actuator head 74 is inserted. The second bore 86 includes adequate clearance for free movement of the actuator head 74 therein. The guide and snap action magnet assembly 82 also includes a stationary latch magnet (not shown) which will be described in further detail below.

Figure 5:
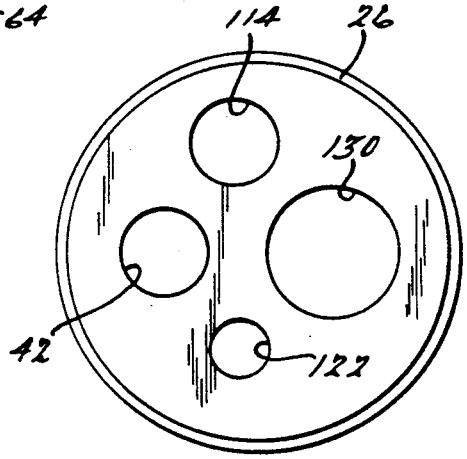
FIG. 5 is a top view of the pump apparatus shown in FIG. 1.
Figure 3:
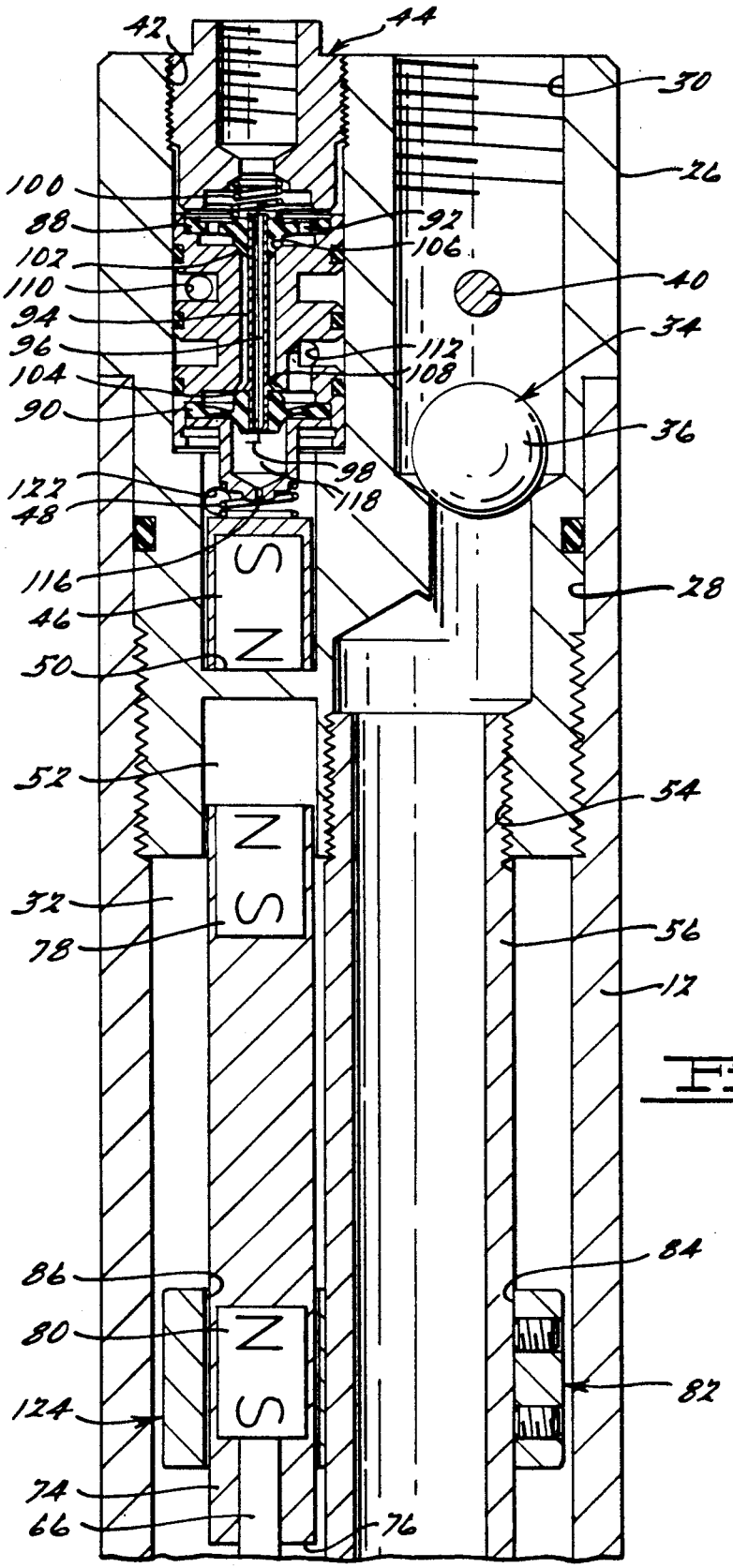
FIG. 3 is an enlarged cross-sectional view of a portion of the pump apparatus shown in FIG. 1 in the refill cycle.
Figure 4:
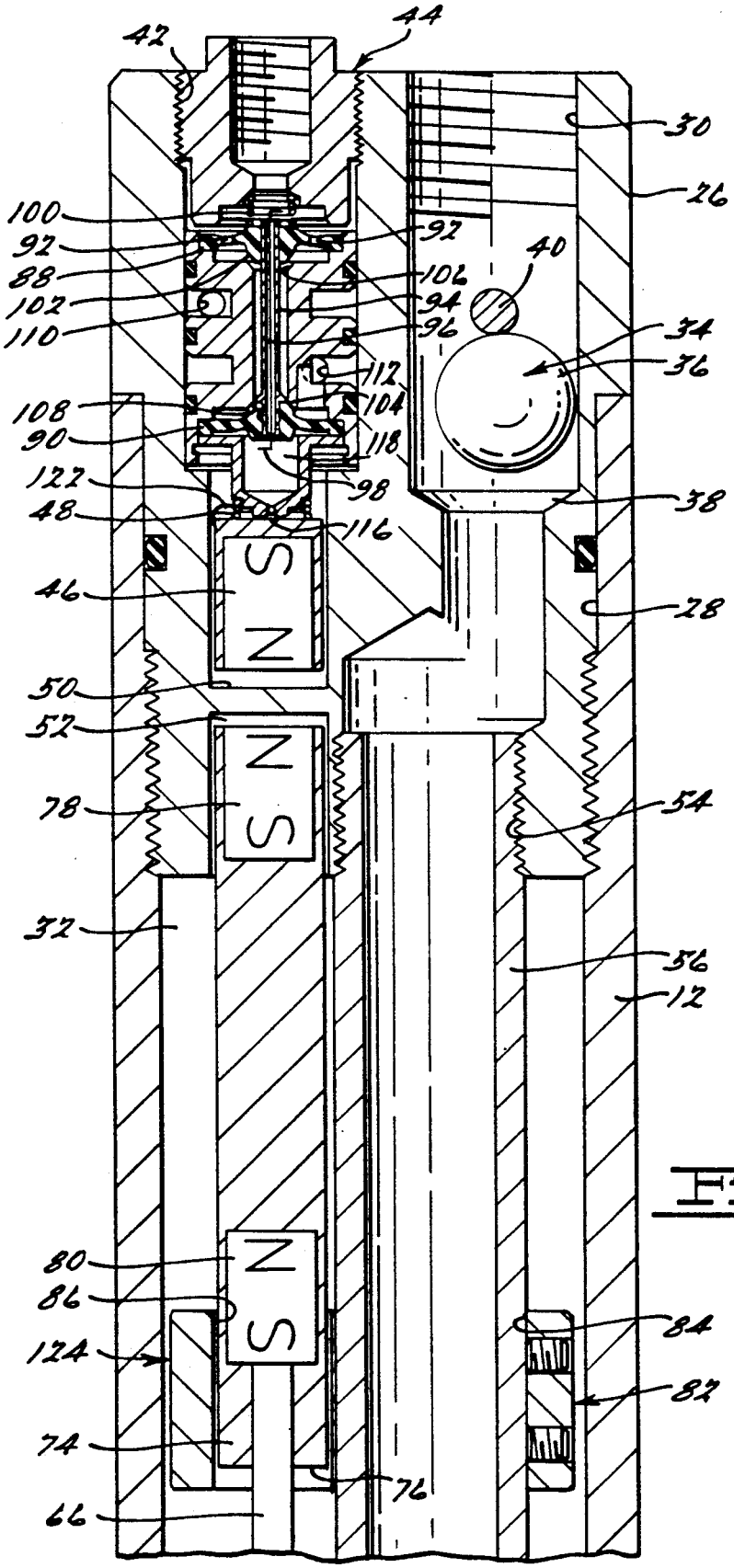
FIG. 4 is a enlarged cross-sectional view of a portion of the pump shown in FIG. 2 in the discharge cycle.

Referring now to FIG. 3 there is shown an enlarged view of the pump cap 26 containing the pneumatic valve 44. The pneumatic valve 44 is preferably a bleed-type air piloted three way control valve. This valve includes a pair of diaphragms, the top one being a perforated diaphragm 88, and the bottom one being a solid diaphragm 90. The perforated diaphragm 88 includes a series of perforations 92. The diaphragms are connected by a valve stem 94 which includes a bleed orifice 96 formed by a axial bore passing completely through the valve stem 94. A wire 98 passes through bleed orifice 96 and contains right angles at either end. A bias spring 100 is located above the perforated diaphragm 88 and acts to bias the perforated diaphragm and solid diaphragm 90 in a downward or valve closed position. The diaphragms 88, 90 include a pair of poppet valve seats. The perforated diaphragm 88 having an upper poppet valve seat 102 and the solid diaphragm 90 having a lower poppet valve seat 104. The upper and lower poppet valve seats 102, 104 form a seal with upper and lower seat surfaces 106, 108 to effect an airtight seal. In FIG. 3, the valve is shown in the normally closed position wherein the upper poppet valve seat 102 is closed and the lower poppet valve seat 104 is open. Conversely, FIG. 4 shows the valve in an open position wherein the upper poppet seat 102 is open and the lower poppet valve seat is closed. The pneumatic valve 44 also includes a cylinder port to pump 110 which provides a means for air to pass from the source of compressed air through the valve 44, through the cylinder port to pump 110 and into the pump chamber 32 when the valve 44 is in the open position as shown in FIG. 4. The pneumatic valve 44 also includes a pump exhaust port 112 which provides a means for venting of the pump chamber 32 by connecting the pump chamber 32 with the main exhaust port 114 shown in FIG. 5 when the pump is in the closed position as shown in FIG. 3. The pneumatic valve 44 also includes a pilot orifice 116 in communication with the bleed chamber 118. A pilot bleed exhaust port 122 is provided adjacent the pilot orifice 116 in the pump cap 26. Referring now to FIG. 5 the pilot bleed exhaust port is shown in a top view of the pump cap 26. In addition, the liquid discharge port 30, the compressed air supply port 42 and the main exhaust 114 are shown in FIG. 5.

The operation of the pump apparatus 10 will now be described. Initially, the pump apparatus 10 is installed in a well with separate lines for liquid discharge attached to the liquid discharge port 30, compressed air supply attached to the compressed air supply port 42, a main exhaust line attached to the main exhaust port 114 and a pilot bleed exhaust line attached to the pilot bleed exhaust port 122. The source of compressed air is then turned on. Compressed air passes into the compressed air port 42 through the bleed orifice 96 located in the valve stem 94. This air passes through the bleed chamber 118 and pilot orifice 116 to the bleed pilot exhaust port 122. At this point the pump is in the refill mode as shown in FIG. 1 with the valve in its normally closed position as shown in FIG. 3. It should be noted that the volume of compressed air passing out into the bleed orifice exhaust 122 is relatively small due to the small opening in the bleed chamber 118. Thus in this mode, the pump is essentially off and little compressed air is wasted.

Figure 2:
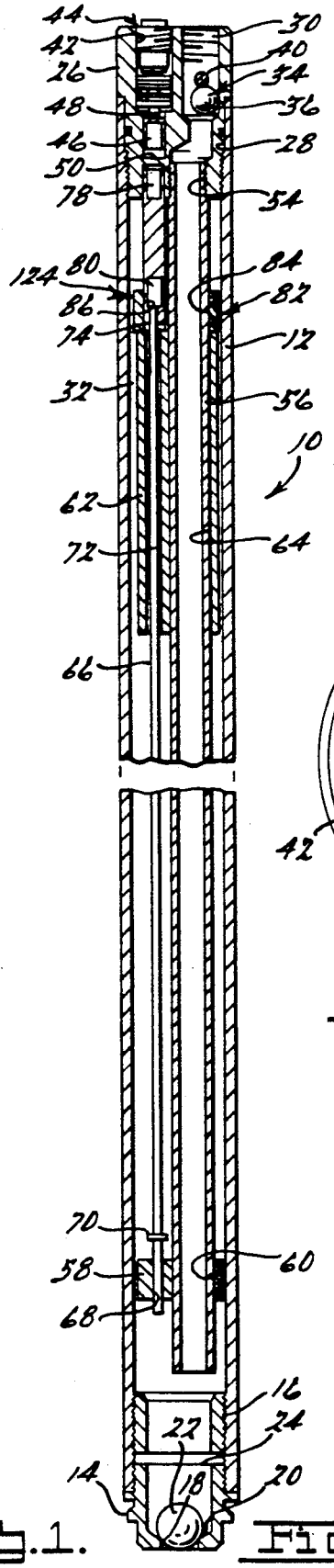
FIG. 2 is a longitudinal cross-sectional view of the pump shown in FIG. 1 in a discharge cycle.

If there is no liquid in the well the pump remains in this state indefinitely. When liquid is introduced into the well it will enter the inlet port 18 and flow past the inlet check valve 14. As the liquid level rises into the pump chamber 32, the float 62 rises also with it and slides upward in the pump chamber. The float 62 continues to rise until it encounters the first float stop 76 on the actuator rod actuation head 74. As the liquid level continues to rise, the float lifts the actuator rod 66. At a preset point the snap action latch magnet 80 on the actuator head 74 passes through the field created by the two opposing stationary latch magnets 124 which are located in the guide and snap action magnet assembly 82. When the snap action latch magnet 80 passes through this field it is pushed upward in a snapping action by the opposing magnet field created by the stationary latch magnets 124. This upward motion continues until the actuation head 74 encounters a stop built into pump cap 26. As seen in FIG. 2, the float 62 will continue to rise until it reaches the lower edge of the guide end snap action magnet assembly 82 which will resist further upward motion by the float 62. It should be noted that the action of the stationary latch magnet 124 has pushed the actuation head 74 upward so that the float stop 76 no longer is in contact with the float 62.

At this point, the actuator magnet 78 on the upper portion of the actuator head 74 creates a magnetic field opposing the pilot magnet 46. This moves the pilot magnet 46 against the air pilot bias spring 48 to make contact with and close the pilot orifice 116.

After the pilot orifice 116 is closed by the pilot magnet 46, the pilot bleed air supply from the pilot bleed orifice 118 builds air pressure to the minimum pilot pressure required to pilot the air valve 44. At this point the pilot pressure moves the solid diaphragm 90 upward which causes the valve stem 94 to move upward along with the perforated diaphragm thereby opening the upper poppet valve seat 102 and closing the lower poppet valve seat 104. At this point the pump apparatus 10 is in the discharge mode as shown in FIGS. 2 and 4. The valve is now in the open position and the lower poppet valve seat will close off the pump exhaust port 112. The upper poppet valve seat 102 is now open which permits compressed air to pass into the cylinder port to pump 110 thereby permitting compressed air to reach the pump chamber 32.

This flow of compressed air will continue into the pump chamber 32 until sufficient pressure is obtained to overcome the hydrostatic head located on the discharge check ball 36. Also, this pressure will cause the inlet check valve 14 to seal. At this point, the liquid in the pump chamber 32 will flow up the inner discharge tube 56 past the discharge check valve 34 and out the liquid discharge port 30.

As liquid is flowing out of the pump, the liquid level in the pump becomes lower. The float 62 follows the liquid level until it encounters the lower float actuator rod stop 70. As the liquid level continues to lower, the dry weight of the float increases its load on the lower actuator rod stop 70. At a preset point the weight of the float 62 overcomes the magnetic latch due to the action of the stationary latch magnets 124 on the snap action latch magnet 80 and the actuator rod assembly moves a preset distance toward the bottom of the pump 10.

After the actuator rod 66 has been disengaged from the magnetic latch 124 holding it in the up position, the pilot magnet 46 moves away from the pilot orifice 116. The compressed air trapped between the pilot orifice 116 and the solid valve diaphragm 90 is free to escape to atmosphere and the pilot pressure returns to atmospheric pressure.

After the pilot air pressure has dropped below the minimum valve pilot pressure, the biasing spring 100 and the air pressure differential move the perforated diaphragm 88, the valve stem 94 and the solid diaphragm 90 to the closed position as shown in FIGS. 1 and 3. The upper poppet valve seat 102 seals and stops the flow of compressed air to the cylinder port to pump 110. At the same time the lower poppet valve seat 104 opens and allows compressed air in the pump chamber 32 to escape to the main exhaust 114 via the pump exhaust port 112.

When the air pressure in the pump body has reached a level that is less than the hydrostatic pressure on the inlet check ball 22, the inlet check ball 22 will open and liquid will fill the pump again providing there is liquid present. As liquid rises in the pump, the float 62 follows the liquid and repeats the cycle described above. If no additional liquid is present, the pump 10 has the advantage that it will remain in a state of rest until liquid rises to a preset level, thus providing "on/off" level control. The benefit of this is a reduced duty cycle on the air compressor, or conservation of compressed air sources. This "on/off" level control is also beneficial to automatically maintain specified minimum liquid levels in applications such as landfills.

In addition it will be appreciated that the isolation of the actuating components of valve 44 and in particular the bleed chamber 118, pilot orifice 116 and the pilot magnet 46 from the liquid being pumped means that these components are not subject to the corrosive or damaging influence of the liquid being pumped. This greatly improves the reliability and useful life of the pump apparatus 10 and pneumatic valve 44. Further, due to the use of magnetic detent and magnetic actuators, the force required to activate the pneumatic valve 44 is minimized thus permitting a smaller and lighter float to be used then would otherwise be required. This reduces the overall size of the well required as well as reducing the size and cost of the pump apparatus 10.

The bleed type air piloted three way control valve 44 used in the present invention is adapted from a standard valve manufactured by Humphrey Products Company. Modifications to this standard valve have been made however. For example, a hole has been drilled through the valve stem 94 to permit the source of compressed air to reach the bleed orifice 116. Without this hole, a separate source of bleed air is necessary to be introduced into the solid diaphragm 90. In addition, the wire 98 in the valve stem 94 permits a larger size bleed orifice 116, then would otherwise be required making this orifice easier to manufacture. This is because the wire reduces the air consumption. For example, the bleed orifice 116 may be about 0.0145 inches with the use of a 0.011 inch diameter wire. The wire has an added benefit of keeping the bleed orifice 116 open and free of debris as the valve shifts back and forth.

It should also be noted that the bleed type air piloted three way control valve 44 in conjunction with the pilot magnet 46 minimizes the above discussed crossover point problem. While this valve 44 does have a crossover point as the valve shifts, the magnetic latching mechanism with the spring bias to the off position makes any crossover insignificant.

It should be recognized that the present invention can be used in a wide variety of underground pumping applications. In particular, the pump can be used in many applications where previously only pumps employing external controllers were practical. While the above description constitutes the preferred embodiments of the present invention it will be appreciated that the invention is susceptible to modification, variation, and change without departing from the proper scope and fair meaning of the accompanying claims.

We claim:

1. A pump for directing liquid out of a well, said pump comprising:

an outer tube forming an outer chamber therein;

an inner tube forming an inner chamber therein;

inlet means at a first end of said tube for permitting liquids to enter said outer and inner chambers;

a cap at a second end of said tubes, said cap containing a discharge port in communication with the second end of said inner tube;

an air inlet port in said cap for permitting pressurized gas to enter said second end of said outer tube;

a vent port for permitting air in said outer chamber to escape to atmosphere;

a float slidably disposed inside said outer tube, said float being buoyant in said liquid, wherein said float slides from said first end of the outer tube to the second end in response to the level of said liquid in said outer chamber;

a valve disposed in said air inlet port for selectively admitting, in a discharge mode, and blocking, in a refill mode, said source of compressed air into said outer chamber, and for selectively venting in said refill mode and blocking in said discharge mode the outer chamber to said vent port;

actuating means responsive to the position of said float and coupled to said valve for actuating said valve from said refill mode to said discharge mode, wherein said liquid is admitted into said inner and outer chambers during said refill mode and said liquid is forced from said outer chamber through said inner chamber at said discharge port during said discharge mode;

wherein said actuating means comprises an actuator rod in said outer chamber moveable by said float, first and second opposing magnets, said first magnet being attached near one end of said actuation rod, and said second magnet being located within said cap means, isolated from said outer chamber and moveable by said first magnet in response to the motion of said float; and said second magnet communicating with said valve to cause said valve to switch from one of said modes to the other.

2. A pump for directing liquid out of a well, said pump comprising:

an outer tube forming an outer chamber therein;

an inner tube forming an inner chamber therein;

inlet means at a first end of said tubes for permitting liquids to enter said outer and inner chamber;

a cap at a second end of said tubes, said cap containing a discharge port in communication with the second end of said inner tube;

an air inlet port in said cap for permitting pressurized gas to enter said second end of said outer tube;

a vent port for permitting air in said outer chamber to escape to atmosphere;

a float slidably disposed inside said outer tube, said float being buoyant in said liquid, wherein said float slides form said first end of the outer tube to the second end in response to the level of said liquid in said outer chamber;

a valve disposed in said air inlet port for selectively admitting, in a discharge mode, and blocking, in a refill mode, said source of compressed air into said outer chamber and for selectively venting in said refill mode and blocking in said discharge mode the outer chamber to said vent port;

actuating means responsive to the position of said float and coupled to said valve for actuating said valve from said refill mode to said discharge mode, wherein said liquid is admitted into said inner and outer chambers during said refill mode and said liquid is forced from said outer chamber through said inner chamber at said discharge port during said discharge mode;

wherein said actuating means comprises an actuator rod in said outer chamber moveable by said float, first and second opposing magnets, said first magnet being attached near one end of said actuation rod, and said second magnet being located within said cap means, isolated from said outer chamber and moveable by said first magnet in response to the motion of said float;

said second magnet communicating with said valve to cause said valve to switch from one of said modes to the other;

magnetic detent means for releasably holding said actuating rod disposed in a fixed position while said valve is in said discharge mode and said liquid is being forced from said discharge port.

3. A pump for directing liquid out of a well, said pump comprising:

an outer tube forming an outer chamber therein;

an inner tube forming an inner chamber therein;

inlet means at a first end of said tubes for permitting liquids to enter said outer and inner chambers;

a cap at a second end of said tubes, said cap containing a discharge port in communication with the second end of said inner tube;

a valve disposed in said air inlet port for selectively admitting, in a discharge mode, and blocking, in a refill mode, said source of compressed air into said outer chamber, and for selectively venting in said refill mode and blocking in said discharge mode the outer chamber to said vent port;

actuating means responsive to the position of said float and coupled to said valve for actuating said valve from said refill mode to said discharge mode, wherein said liquid is admitted into said inner and outer chambers during said refill mode and said liquid is forced from said outer chamber through said inner chamber at said discharge port during said discharge mode;

wherein said actuation rod means comprises an actuator rod in said outer chamber moveable by said float, first and second opposing magnets, said first magnet being attached near one end of said actuation rod, and said second magnet being located within said cap means, isolated from said outer chamber and moveable by said first magnet in response to the motion of said float;

said second magnet communicating with said valve to cause said valve to switch from one of said mode to the other;

magnetic detent means for releasably holding said actuating rod disposed in a fixed position while said valve is in said discharge mode and said liquid is forced from said discharge port; and wherein said detent means comprises a magnet fixably attached to said actuating rod and an adjacent, second magnet attached an fixed relation to said outer and inner tubes, wherein the magnetic attraction between said first and second magnet is sufficiently strong to hold said actuating rod in a fixed position during the discharge mode, but sufficiently weak to overcome by the weight of said float acting on such actuation rod when said pump is empty.

4. A pump for directing liquid out of a well, said pump comprising:

an outer tube forming an outer chamber therein;

an inner tube forming an inner chamber therein;

inlet means at a first end of said tubes for permitting liquids to enter said outlet and inner chambers;

a cap at a second end of said tubes, said cap containing a discharge port in communication with the second end of said inner tube;

an air inlet port in said cap for permitting pressurized gas to enter said second end of said outer tube;

a vent port for permitting air in said outer chamber to escape to atmosphere;

a float slidably disposed inside said outer tube, said float being buoyant in said liquid, wherein said float slides from said first end of the outer tube to the second end in in response to the level of said liquid in said outer chamber;

a valve disposed in said air inlet port for selectively admitting, in a discharge mode, and blocking, in a refill mode, said source of compressed air into said outer chamber, and for selectively venting in said refill mode and blocking in said discharge mode the outer chamber to said vent port;

actuating means responsive to the position of said float and coupled to said valve for actuating said valve from said refill mode to said discharge mode, wherein said liquid is admitted into said inner and outer chambers during said refill mode and sail liquid is forced from said outer chamber through said inner chamber at said discharge port during said discharge mode;

wherein said actuating rod means comprises an actuator rod in said outer chamber moveable by said float, first and second opposing magnets, said first magnet being attached near one end of said actuation rod, and said second magnet being located within said cap means, isolated from said outer chamber and moveable by said first magnet in response to the motion of said float;

said second magnet communicating with said valve to cause said valve to switch from one of said modes to the other;

wherein the opposing magnetic fields of said first and second magnets moves said second magnet toward said valve, and said liquid entering said pump causes said float to move said actuation rod and said first magnet toward said valve when said liquid has substantially filled said outer chamber.

5. A pump for directing liquid out of a well, said pump comprising:

an outer tube forming an outer chamber therein;

an inner tube forming an inner chamber therein;

inlet means at a first end of said tubes for permitting liquids to enter said outer and inner chamber;

a cap at a second end of said tubes, said cap containing a discharge port in communication with the second end of said inner tube;

an air inlet port in said cap for permitting pressurized gas to enter said second end of said outer tube;

a vent port for permitting air in said outer chamber to escape to atmosphere;

a float slidably disposed inside said outer tube, said float being buoyant in said liquid, wherein said float slides from said first end of the outer tube to the second end in response to the level of said liquid in said outer chamber;

a valve disposed in said airinlet port for selectively admitting, in a discharge mode, and blocking, in a refill mode, said source of compressed air into said outer chamber, and for selectively venting in said refill mode and blocking in said discharge mode the outer chamber to said vent port;

actuating means responsive to the position of said float and coupled to said valve for actuating said valve from said refill mode to said discharge mode, wherein said liquid refill mode and said liquid is forced from said outer chamber through said inner chamber at said discharge port during said discharge mode;

wherein said actuating rod means comprises an actuator rod in said outer chamber moveable by said float, first and second opposing magnets, said first magnet being attached near one end of said actuation rod, and said second magnet being located within said cap means, isolated from said outer chamber and moveable by said first magnet in response to the motion of said float;

said second magnet communicating with said valve to cause said valve to switch from one of said modes to the other;

wherein the opposing magnetic fields of said first and second magnets moves said second magnet toward said valve, and said liquid entering said pump causes said float to move said actuation rod and said first magnet toward said valve when said liquid has substantially filled said outer chamber; wherein said first magnet is pulled away from said second magnet, causing said second magnet to drop away from said valve when said liquid is emptied from said outer chamber discharge mode, and the force of gravity causes said float to move said actuation rod away from said valve.

* * * * *

UNITED STATES PATENT AND TRADEMARK OFFICE

CERTIFICATE OF CORRECTION

PATENT NO. : 5,141,404

DATED : August 25, 1992

INVENTOR(S) : Kevin Newcomer et al.

It is certified that error appears in the above-identified patent and that said Letters Patent is hereby corrected as shown below:

On the title page: Item [56]

under "References Cited", "U.S. PATENT DOCUMENTS",
Insert --4,332,530 6/1982 Laster--.

under "References Cited", "U.S. PATENT DOCUMENTS",
"3,082,698 3/1969 Smith" should be --3,082,698 3/1963 Smith--.

under "References Cited", "U.S. PATENT DOCUMENTS",
"2,667,995 2/1954 Pool et al." should be
--2,667,895 2/1954 Pool et al.--.

Abstract, line 12,
"is" should be --to--.

Column 1, line 19,
"is it" should be --it is--.

Column 1, line 62,
"maybe" should be --may be--.

Column 2, line 40,
"a" (first occurrence) should be --an--.

Column 3, line 9,
"provide" should be --provided--.

Column 3, line 31,
"an" should be --and--.

UNITED STATES PATENT AND TRADEMARK OFFICE

CERTIFICATE OF CORRECTION

PATENT NO. : 5,141,404

DATED : August 25, 1992

INVENTOR(S) : Kevin Newcomer et al.

It is certified that error appears in the above-identified patent and that said Letters Patent is hereby corrected as shown below:

Column 3, line 60,
"an" should be --and--.

Column 4, line 2,
after ".", insert --)--.

Column 5, line 18,
"a" should be --an--.

Column 5, line 34,
after "poppet" (first occurrence), insert --valve--.

Column 7, line 46,
"then" should be --than--.

Column 7, line 59,
"then" should be --than--.

Column 9, line 9, claim 2,
"form" should be --from--.

Column 10, line 8, claim 3,
after "is", (second occurrence), insert --being--.

Column 10, line 12, claim 3,
"an" should be --in--.

UNITED STATES PATENT AND TRADEMARK OFFICE

CERTIFICATE OF CORRECTION

PATENT NO. : 5,141,404

DATED : August 25, 1992

INVENTOR(S) : Kevin Newcomer et al.

It is certified that error appears in the above-identified patent and that said Letters Patent is hereby corrected as shown below:

Column 10, line 17, claim 3,
after "to", insert --be--.

Column 10, line 25, claim 4,
"outlet" should be --outer--.

Column 10, line 36, claim 4,
delete "in" (second occurrence).

Column 10, line 48, claim 4,
"sail" should be --said--.

Column 11, line 19, claim 5,
"airinlet" should be --air inlet--.

Signed and Sealed this

Sixteenth Day of November, 1993

*Attest:*

Bruce Lehman

BRUCE LEHMAN

*Attesting Officer*

*Commissioner of Patents and Trademarks*